US009811053B2

(12) United States Patent
Kirchhof

(10) Patent No.: US 9,811,053 B2
(45) Date of Patent: Nov. 7, 2017

(54) REVERSER FOR TIMEPIECE AND SELF-WINDING WATCH COMPRISING THE SAME

(71) Applicant: Société anonyme de la Manufacture d'horlogerie Audemars Piguet & Cie, Le Brassus (CH)

(72) Inventor: Jérôme Kirchhof, Neuchâtel (CH)

(73) Assignee: Société anonyme de la Manufacture d'horlogerie Audemars Piguet & Cie, La Brassus (CH)

( * ) Notice: Subject to any disclaimer, the term of this patent is extended or adjusted under 35 U.S.C. 154(b) by 0 days.

(21) Appl. No.: 15/158,014

(22) Filed: May 18, 2016

(65) Prior Publication Data

US 2016/0363908 A1 Dec. 15, 2016

(30) Foreign Application Priority Data

Jun. 11, 2015 (EP) ..... 15171705

(51) Int. Cl.
*G04B 11/02* (2006.01)
*G04B 5/02* (2006.01)
(Continued)

(52) U.S. Cl.
CPC ..... *G04B 5/02* (2013.01); *G04B 5/08* (2013.01); *G04B 5/14* (2013.01); *G04B 11/006* (2013.01)

(58) Field of Classification Search
CPC . G04B 5/02; G04B 5/14; G04B 11/00; G04B 11/006; G04B 11/02; G04B 11/022
See application file for complete search history.

(56) References Cited

U.S. PATENT DOCUMENTS 3,306,025 A * 2/1967 Kocher ..... G04B 5/195 368/148
6,409,379 B1 6/2002 Gabathuler et al.
(Continued)

FOREIGN PATENT DOCUMENTS

DE 952879 C 11/1956
DE 23 26 915 A1 12/1973
(Continued)

OTHER PUBLICATIONS

Humbert B, "La montre Suisse à remontage automatique," Journal Suisse D'Hologerie Et De Bijouterie, Scriptar S.A. Lausanne, CH, vol. 90, No. 5, Sep. 1, 1965, pp. 677-685.
(Continued)

*Primary Examiner* — Amy Cohen Johnson
*Assistant Examiner* — Jason Collins
(74) *Attorney, Agent, or Firm* — Drinker Biddle & Reath LLP

(57) ABSTRACT

A reverser for a timepiece comprises a first input wheel which carries a first satellite pinion. An output mobile assembly comprises a first ratchet with which the first satellite pinion forms a click locking in rotation the output mobile assembly with respect to the first input wheel only in a first direction of rotation. A second input wheel has the same axis of rotation as the first input wheel and the output mobile assembly. A second satellite pinion and a second ratchet form together a click locking in rotation the output mobile assembly with respect to the second input wheel only in the first direction of rotation.

11 Claims, 4 Drawing Sheets

(51) Int. Cl.

| | |
|---|---|
| ***G04B 5/08*** | (2006.01) |
| ***G04B 5/14*** | (2006.01) |
| ***G04B 11/00*** | (2006.01) |

(56) References Cited

U.S. PATENT DOCUMENTS

| | | | | |
|---|---|---|---|---|
| 7,287,901 | B1 * | 10/2007 | Helfer | F16D 41/069 368/147 |
| 9,400,487 | B2 * | 7/2016 | Goeller | G04B 3/006 |
| 2004/0130972 | A1 | 7/2004 | Watanabe et al. | |
| 2010/0135127 | A1 * | 6/2010 | Born | G04B 5/12 368/127 |
| 2015/0198925 | A1 | 7/2015 | Cornibé et al. | |

FOREIGN PATENT DOCUMENTS

| | | | |
|---|---|---|---|
| EP | 1046965 | A1 | 10/2000 |
| FR | 1079576 | A | 12/1954 |

OTHER PUBLICATIONS

Extended European Search Report dated Dec. 7, 2015 in European Application No. 15171705.5.

* cited by examiner

FIG. 1
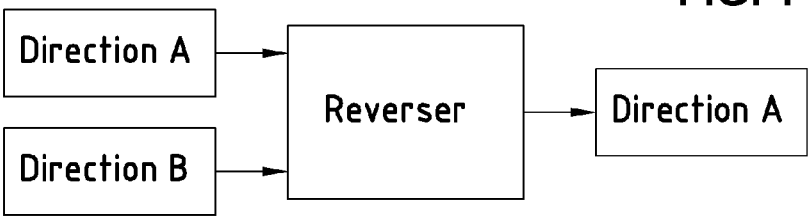
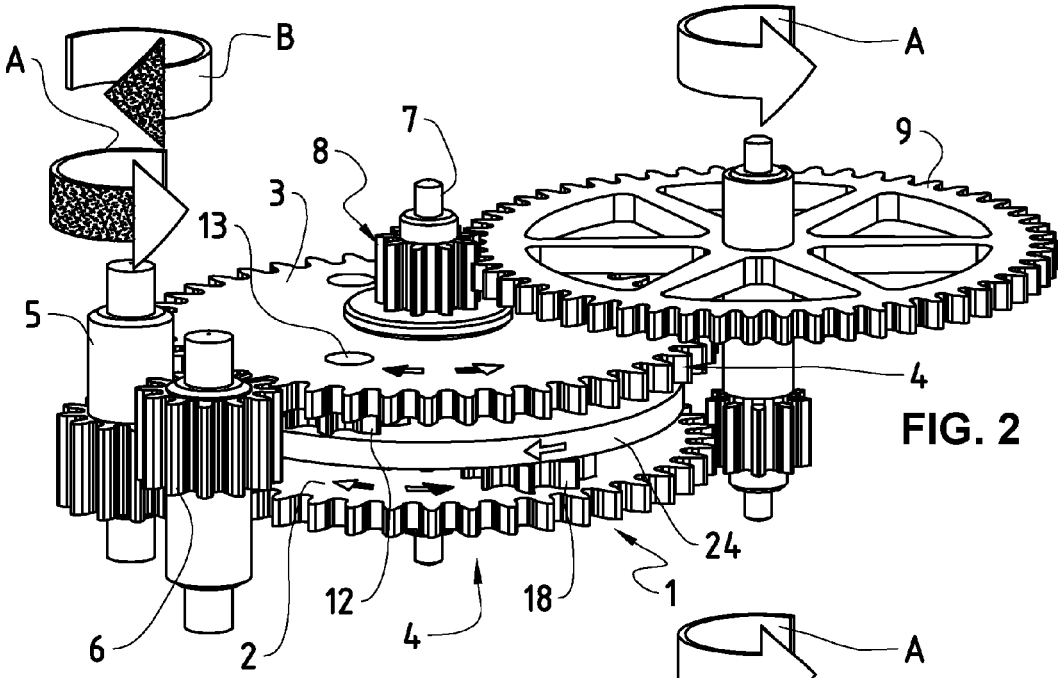
FIG. 2
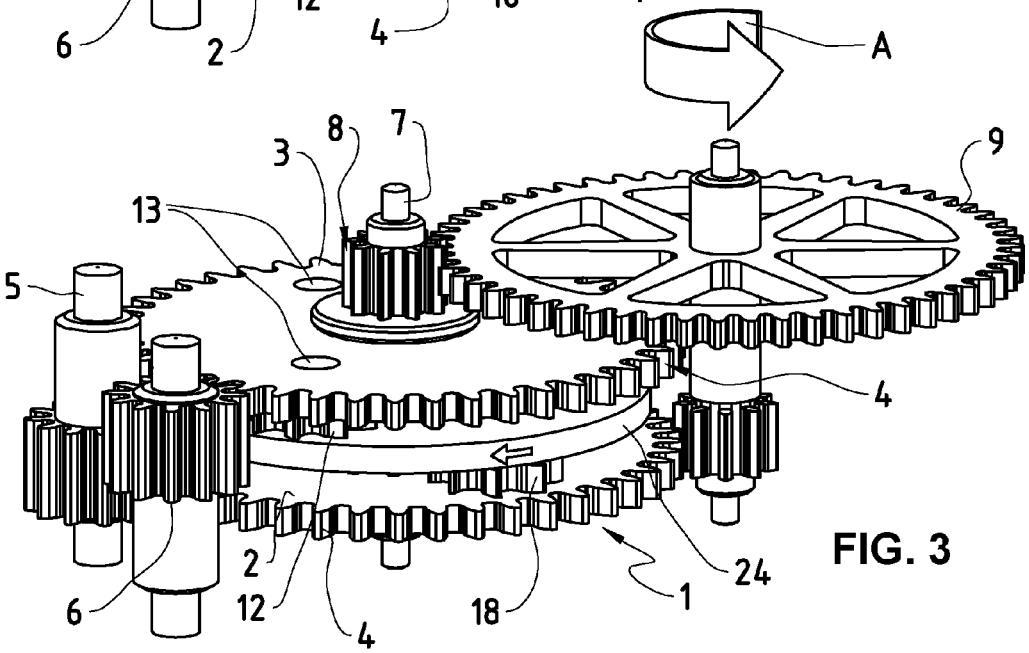
FIG. 3

B

REVERSER FOR TIMEPIECE AND SELF-WINDING WATCH COMPRISING THE SAME

CROSS-REFERENCE TO RELATED APPLICATIONS

This application claims priority under 35 U.S.C. §119 to European Patent Application No. 15171705, filed on Jun. 11, 2015, which is incorporated by reference herein in its entirety.

FIELD OF THE INVENTION

The present invention relates to the field of horology. More specifically, it concerns a reverser for a timepiece and a self-winding watch comprising this reverser.

BACKGROUND OF THE INVENTION

The German patent DE-952 879, published in 1956, describes a freewheel device clutch for a self-winding watch. This device comprises two input wheels driven by a winding wheel. Each of these input wheels is coupled to a pinion, around which a satellite pinion, forming a pawl carried by a lower wheel, can move. The two lower wheels mesh with one another. One of them is coupled to an output wheel. When the winding wheel turns in a first direction, the driving force is transmitted to the output wheel through a first input wheel, a first pinion, a first satellite and a first lower wheel, which meshes with a second lower wheel coupled to the output wheel. When the winding wheel turns in a second direction, opposite the first direction, the driving force is transmitted to the output wheel through a second input wheel, a second pinion and a second satellite which the second lower wheel, coupled to the output wheel, carries.

The French patent FR-1 079 576, published in 1954, proposes a self-winding device for a clockwork mechanism. In this device, a winding wheel carries a first satellite pinion forming a pawl. This winding wheel meshes with a wheel which carries a second satellite pinion forming a pawl. The movement of the winding wheel can have two directions. Depending upon its direction, it is transmitted in a first way or in a second way to an output wheel. More precisely, when the winding wheel turns in a first direction, the first satellite pinion drives a first output pinion. When the winding wheel turns in a second direction, opposite the first direction, the second satellite pinion drives a second output pinion. A same output wheel receives the driving force from the first output pinion or the driving force from the second output pinion.

The devices of the aforementioned documents DE-952 879 and FR-1 079 576 have notably the drawback of taking up a lot of space, and it seems that despite the almost 60 years which have passed since their publication, no one has managed to this day to resolve this problem of bulkiness in a satisfactory way.

BRIEF DESCRIPTION OF THE INVENTION

According to one aspect of the present invention, a reverser for a timepiece is provided. The reverser for a timepiece preferably comprises:

- a first input wheel, rotational about an axis of rotation, in a first direction of rotation and in a second direction of rotation opposite to the first direction of rotation,
- at least one first satellite pinion carried by the first input wheel,

- an output mobile assembly comprising a first ratchet with which the first satellite pinion forms a click, locking in rotation the output mobile assembly with respect to the first input wheel only in the first direction of rotation from among the first and second directions of rotation,
- a second input wheel which has the same axis of rotation as the first input wheel and as the output mobile assembly, and
- at least one second satellite pinion and a second ratchet which form together a click, locking in rotation the output mobile assembly with respect to the second input wheel only in the first direction of rotation from among the first and second directions of rotation.

One object of the features of the invention is to provide a timepiece reverser of substantially reduced size.

The reverser for a timepiece according to the features of the invention has the advantage of being able to have a simple construction. It has another advantage, which is that the first input wheel, the second input wheel, the satellite pinions and the output mobile assembly can form together a subassembly which can be preassembled and of which the constituent parts can stay together by themselves.

The reverser for a timepiece defined above can incorporate one or more other advantageous features, alone or in combination, in particular from among those defined in the following.

Advantageously, the second input wheel carries the second satellite pinion, the output mobile assembly comprising the second ratchet which is coupled to the first ratchet. When such is the case, the second satellite pinion turns on itself, but not about the second ratchet, when the output mobile assembly is driven in rotation from downstream, for example from a barrel arbor because of a manual winding, in the case where a gear train connects kinematically this barrel arbor to the output mobile assembly.

Advantageously, the first and the second input wheel are mounted in a rotating way on the output mobile assembly. When such is the case, the reverser can have a simple construction and/or a reduced bulkiness.

Advantageously, the output mobile assembly comprises at least one retaining shoulder, this retaining shoulder and the first ratchet retaining axially the first input wheel between them. When such is the case, the first ratchet fulfils a retaining function in addition to its ratchet function, which can lead to a simplification.

Advantageously, the output mobile assembly comprises an assembling shaft and at least one assembling ring which is slipped on this assembling shaft and which supports the first ratchet in a way so as to couple this first ratchet to the assembling shaft, the first input wheel being mounted in a rotating way on the assembling ring which comprises the retaining shoulder. When this is the case, the assembling of the reverser and/or the manufacture of at least certain of its components can be simplified.

Advantageously, the output mobile assembly comprises an assembling shaft which passes through at least the first input wheel, the second input wheel and the first ratchet. When this is the case, the assembling of the reverser and/or the manufacture of at least certain of its components can be simplified.

Advantageously, the first and second satellite pinions are located between the first input wheel and the second input wheel. When such is the case, the satellite pinions are protected by the first and second input wheels.

Advantageously, the reverser for a timepiece comprises a separation plate located between a circular path of the first satellite pinion and a circular path of the second satellite pinion. Such a separation plate thus disposed can prevent an adverse catching between the first and second satellite pinions. It can also simplify the construction of the reverser and/or reduce the thickness by serving to retain axially at least one of the satellite pinions on one side.

Advantageously, the first ratchet has an outer click toothing, the second ratchet also having an outer click toothing.

Advantageously, the reverser for a timepiece comprises a plurality of first satellite pinions able to co-operate with the first ratchet in a way so as to lock in rotation the output mobile assembly with respect to the first input wheel only in the first direction of rotation. When this is the case, the path lost during a reversal of the direction of drive at the input can be reduced. In addition, the coupling achieved by the first satellite pinions is distributed in several points. Moreover, the first satellite pinions can be disposed in such a way that the center of gravity of the totality of their individual masses is at least approximately centered.

The invention also has as subject matter a self-winding watch comprising a reverser for a timepiece such as defined in the foregoing.

The self-winding watch defined above can incorporate one or more other advantageous features, alone or in combination, in particular from among those defined in the following.

Advantageously, the self-winding watch comprises a gear train for driving the first and second input wheels in rotation in opposite directions.

BRIEF DESCRIPTION OF DRAWINGS

Other advantages and features will follow more clearly from the following description of a particular embodiment of the invention, given by way of non-limiting example and represented in the appended drawings in which:

FIG. 1 is a block diagram illustrating the principle of operation of a reverser;

FIG. 2 is a perspective view of a reverser according to one embodiment of the invention and of a reduction mobile assembly associated with this reverser within a mechanism for transmitting a winding movement and for reversing, or not, this winding movement depending upon its direction;

FIG. 3 is a perspective view which represents the same mechanism as FIG. 2 and which distinguishes itself from this FIG. 2 solely in that it illustrates a different mode of operation;

DESCRIPTION OF A PREFERRED EMBODIMENT OF THE INVENTION

Figure 4A:
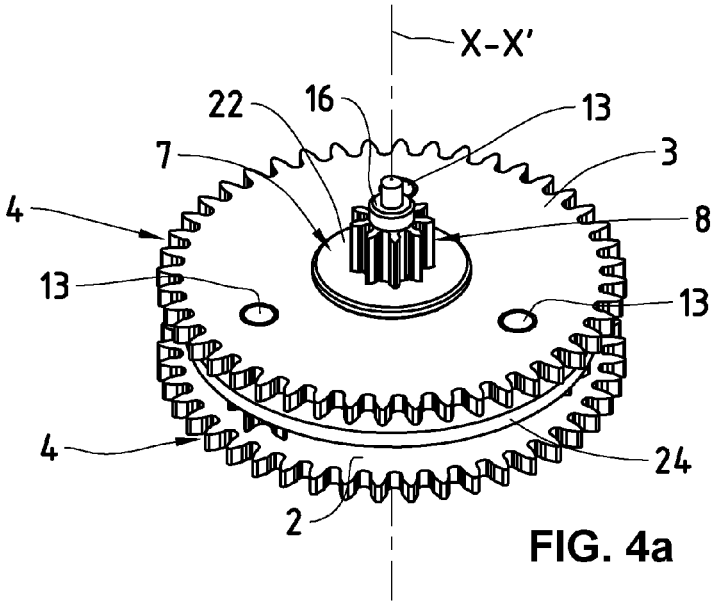
FIG. 4*a* is a perspective view of the reverser visible in FIGS. 2 and 3.

In the sense used here and in the appended claims, a "reverser" is a mechanism which transmits a rotational movement while reversing, or not, this rotational movement depending upon its direction at the input of the reverser, which FIG. 1 illustrates. In this FIG. 1, the direction A and the direction B are two opposite rotational directions which a driving force received by a reverser can have. This reverser transmits a rotational movement in direction A without reversing it. The reverser reverses a rotational movement in direction B when it transmits this movement of rotation. The rotational movement at the output of the reverser is thus always in the direction A.

In FIGS. 2 and 3, a reverser 1 according to the invention is able to perform the operation illustrated in FIG. 1. This reverser 1 comprises a first input wheel 2 and a second input wheel 3, each having a peripheral input toothing 4.

Upstream from the input wheels 2 and 3, an input pinion 5 and a intermediate pinion 6 form a gear train provided to drive the input wheels 2 and 3 in rotation in opposite directions. The input pinion 5 meshes with the first input wheel 2 and with the intermediate pinion 6, which itself meshes with the second input wheel 3.

An output mobile assembly 7 of the reverser 1 comprises an output toothing 8 meshing with the toothing of a constituent wheel of a reduction mobile assembly 9 located at the output of the reverser 1.

As can be seen in FIG. 4*a*, the first input wheel 2, the second input wheel 3 and the output mobile assembly 7 are coaxial and have the same axis of rotation X-X'.

Figure 4B:
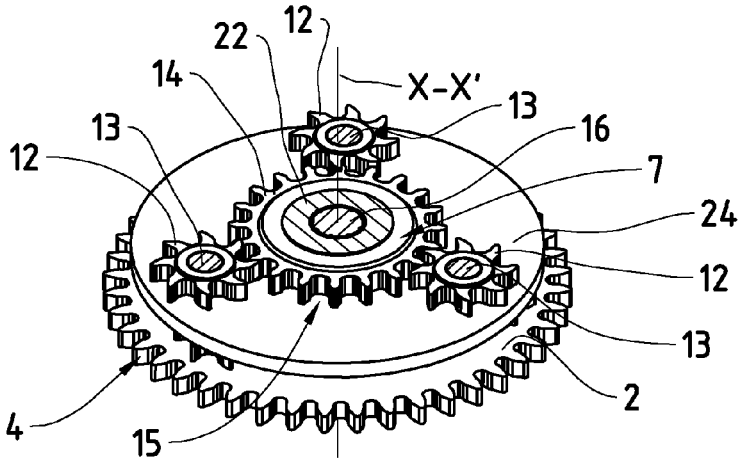
FIG. 4*b* is a perspective and cross-sectional view, which represents a portion of the reverser of FIGS. 2, 3 and 4*a;*

The second input wheel 3 carries a plurality of satellite pinions 12, which are visible in FIG. 4*b*. In the example shown, these satellite pinions 12 are three in number. There can also be more or fewer. For example, there can be just a single satellite pinion 12. Each satellite pinion 12 is mounted in a rotating way on a shaft 13, which is coupled to the second input wheel 3 by being press-fitted in a hole of the latter. Each satellite pinion 12 fulfils the function of a pawl and it is engaged with the click toothing 15 of a ratchet 14, which forms part of the output mobile assembly 7 by being coupled to a constituent assembling shaft 16 of this output mobile assembly 7. The satellite pinions 12 and the ratchet 14 form together a click, coupling in rotation the output mobile assembly 7 to the second input wheel 3 only in one direction. Indeed, a coupling carried out in such a way that the second input wheel 3 can drive in rotation the output mobile assembly 7 occurs during a rotation of the second input wheel 3 in one of its two directions of rotation, but does not take place during a rotation of this second input wheel 3 in its other direction of rotation.

Figure 4C:
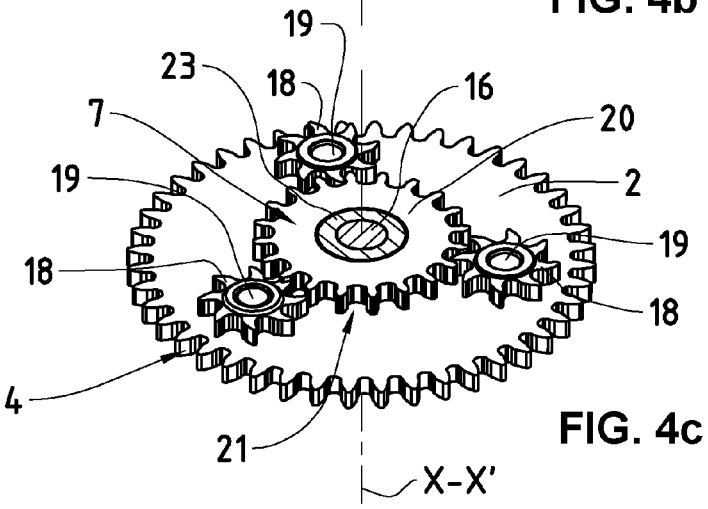
FIG. 4*c* is another perspective and cross-sectional view, which represents a portion of the reverser of FIGS. 2, 3, 4*a* and 4*b;*

The first input wheel 2 carries a plurality of satellite pinions 18, which are visible in FIG. 4*c*. In the example shown, these satellite pinions 18 are three in number. There can also be more or fewer. For example, there can be just a single satellite pinion 18. Each satellite pinion 18 is mounted in a rotating way on a shaft 19, which is coupled to the first input wheel 2 by being press-fitted in a hole of the latter. Each satellite pinion 18 fulfils the function of a pawl and it is in contact with the click toothing 21 of a ratchet 20, which forms part of the output mobile assembly 7 by being coupled to the assembling shaft 16. The satellite pinions 18 and the ratchet 20 form together a click, coupling in rotation the output mobile assembly 7 to the first input wheel 2 only in one direction. Indeed, a coupling carried out in such a way that the first input wheel 2 can drive in rotation the output mobile assembly 7 occurs during a rotation of the first input wheel 2 in one of its two directions of rotation, but does not take place during a rotation of this first input wheel 2 in its other direction of rotation.

Figure 5:
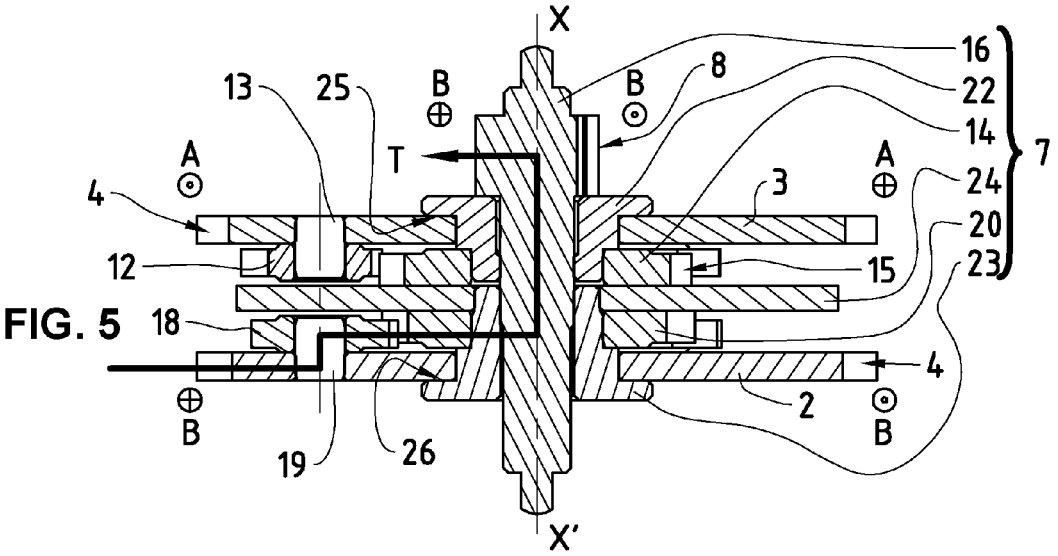
FIG. 5 is an axial section view of the reverser visible in FIGS. 2, 3, 4*a*, 4*b*, 4*c*, and illustrates a first mode of operation of this reverser.

As can be seen in FIG. 5, an assembling ring 22 couples the ratchet 14 to the assembling shaft 16, which defines the output toothing 8. An assembling ring 23 couples the ratchet 20 and a separation plate 24 to the assembling shaft 16. In summary, the output mobile assembly 7 comprises the assembling shaft 16, the assembling ring 22, the ratchet 14, the assembling ring 23, the ratchet 20 and the separation plate 24, which are joined to one another.

The input wheels 2 and 3 are carried by the output mobile assembly 7 in such a way as to be able to turn freely with respect to the latter, about the axis of rotation X-X'. The ratchet 14 and a retaining shoulder 25 present on the assembling ring 22 retain between them the second input wheel 3. The ratchet 20 and a retaining shoulder 26 present on the assembling ring 23 retain between them the first input wheel 2.

The satellite pinions 12 and 18, as well as the ratchets 14 and 20, are located between the input wheels 2 and 3. The separation plate 24 separates two flattened spaces from one another, i.e. a space where the satellite pinions 12 circulate and a space where the satellite pinions 18 circulate. The separation plate 24 retains axially the satellite pinions 12 and 18 on one side and thus prevents them from slipping away from the shafts 13 and 19 which support them.

The subassembly of FIG. 5 is compact and has little bulk. Its various components remain assembled with respect to one another. The subassembly of FIG. 5 can be preassembled before being integrated in a watch movement.

Figure 6:
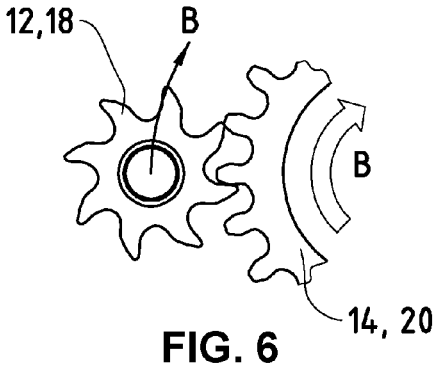
FIGS. 6 and 7 are two views of details which illustrate how a click, present in several examples in the reverser of FIGS. 2, 3, 4*a*, 4*b*, 4*c* and 5, functions depending upon the direction of rotation of a satellite pinion of this click.
Figure 7:
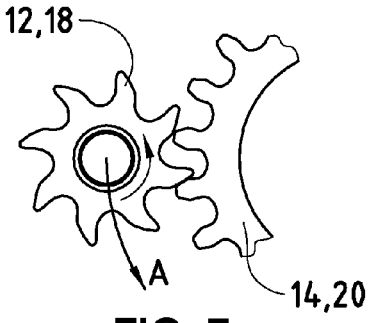

FIGS. 6 and 7 illustrate the operation of the above-mentioned clicks. The teeth of the satellite pinions 12 are asymmetrical. When a satellite pinion 12 turns in the direction B about the axis of rotation X-X', it couples with the toothing of the ratchet 14 without being able to turn on itself, and, therefore, drives with it in rotation this ratchet 14, which FIG. 6 illustrates. In FIG. 7, a satellite pinion 12 turns in the direction A, opposite the direction B, about the axis of rotation X-X'. When such is the case, this satellite pinion 12 turns on itself without being impeded by the toothing of the ratchet 14, and without driving with it this ratchet 14 about the rotation axis X-X'.

The preceding on the subject of behaviour of the satellite pinions 12 with respect to the ratchet 14 applies to the behaviour of the satellite pinions 18 with respect to the ratchet 20.

FIG. 2 is referred to again. When the input pinion 5 is driven in the direction A, it drives the first input wheel 2 in the direction B and the reverser 1 functions as illustrated in FIG. 5, where the arrow T symbolizes the transmission of the drive torque during this functioning. In this FIG. 5, the satellite pinions 18 are driven in the direction B about the rotation axis X-X' and they are locked with respect to the ratchet 20 which they drive with them in this direction B, so that the output mobile assembly 7 likewise turns in the direction B. The reduction mobile assembly 9 then turns in the direction A.

Figure 8:
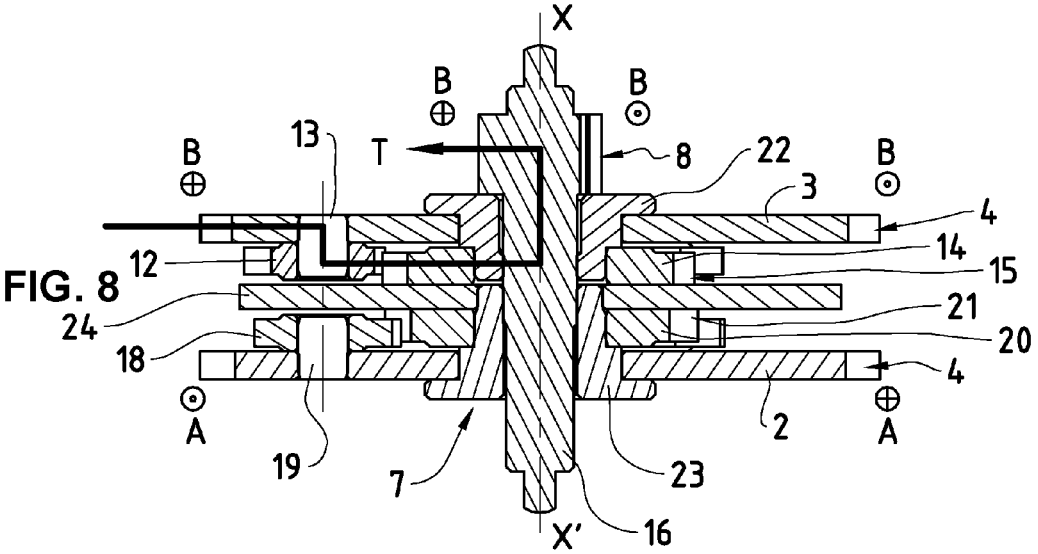
FIG. 8 is an axial section view which is identical to FIG. 5 except that it illustrates a second mode of operation of the reverser of FIGS. 2, 3, 4*a*, 4*b*, 4*c* and 5.

FIG. 2 is still referred to. When the input pinion 5 is driven in the direction B, it drives the intermediate pinion 6 in the direction A. This intermediate pinion 6 drives, in turn, the second input wheel 3, which turns in the direction B. The reverser 1 then functions as illustrated in FIG. 8, where the arrow T symbolizes the transmission of the drive torque during this operation. In this FIG. 8, the satellite pinions 12 are driven in the direction B about the rotation axis X-X', and they are locked with respect to the ratchet 14, which they drive with them in this direction B, so that the output mobile assembly 7 likewise turns in the direction B. The reduction mobile assembly 9 then turns in the direction A.

In conclusion, the reduction mobile assembly 9 turns in the direction A both when the input pinion 5 is driven in the direction A and when this input pinion 5 is driven in the direction B.

The reverser 1 can in particular be used for an automatic winding, i.e. for the winding of a mainspring of a barrel (not shown) of a watch starting with the movements of an oscillating weight (not shown) driven by its own weight when the orientation of the watch is changed. The oscillating weight drives the input pinion 5 sometimes in the direction A and sometimes in the direction B. When this oscillating weight is displaced, the reduction mobile assembly 9 is always driven in the direction A and, therefore, it drives the barrel arbor of the barrel always in the direction of winding, whatever the direction of movement of the oscillating weight is.

FIG. 3 illustrates what results when the mainspring of the barrel is wound manually and not as a result of the movements of the oscillating weight. In this FIG. 3, the reduction mobile assembly 9 is driven in the direction A from the barrel arbor, whereas the input pinion 5 is immobile. The satellite pinions 12 and the satellite pinions 18 then turn on themselves, but they do not turn about the rotation axis X-X', which is advantageous in particular in terms of attrition.

Figure 9:
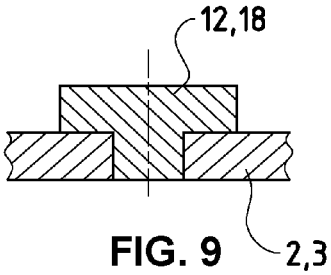
FIGS. 9 to 14 are detail views, in axial section, of which each represents one of several possible variants for arranging a satellite pinion of the reverser of FIGS. 2, 3, 4*a*, 4*b*, 4*c*, 5 and 8.
Figure 10:
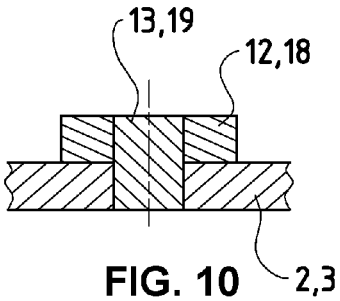
Figure 11:
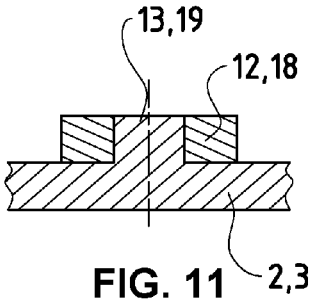
Figure 12:
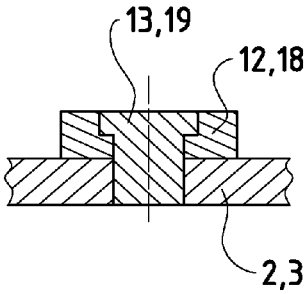
Figure 13:
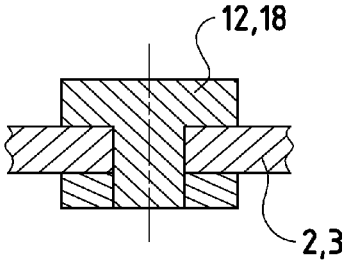
Figure 14:
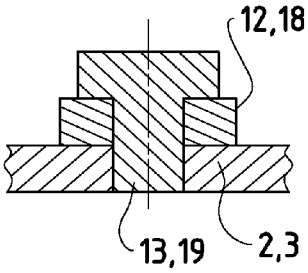

FIGS. 9 to 14 each represent one of the multiplicity of possible arrangements of the satellite pinions 12 and 18. The arrangement shown in FIG. 10 is that used in the reverser 1 of FIG. 2. In the arrangements of FIGS. 9 to 11, the satellite pinions 12 and 18 can slip away in the absence of the separation plate 24, which retains them axially in one direction when the reverser is assembled.

The invention is not limited to the embodiment previously described nor to the variants proposed above. In particular, at least one of the click toothings 15 and 21 can be internal instead of being external.

The invention claimed is:

1. A reverser for a timepiece, comprising:

a first input wheel, rotational about an axis of rotation, in a first direction of rotation and in a second direction of rotation opposite to the first direction of rotation;

at least one first satellite pinion carried by the first input wheel;

an output mobile assembly comprising a first ratchet with which the first satellite pinion forms a click locking in rotation the output mobile assembly with respect to the first input wheel only in the first direction of rotation from among the first and second directions of rotation;

a second input wheel which has the same axis of rotation as the first input wheel and as the output mobile assembly;

at least one second satellite pinion; and a second ratchet with which the second satellite pinion forms a click locking in rotation the output mobile assembly with respect to the second input wheel only in the first direction of rotation from among the first and second directions of rotation.

2. The reverser for a timepiece according to claim 1, wherein the second input wheel carries the second satellite pinion, the output mobile assembly comprising the second ratchet which is coupled to the first ratchet.

3. The reverser for a timepiece according to claim 1, wherein the first input wheel and the second input wheel are rotatably mounted on the output mobile assembly.

4. The reverser for a timepiece according to claim 3, wherein the output mobile assembly comprises at least one retaining shoulder, the retaining shoulder and the first ratchet retaining axially the first input wheel between them.

5. The reverser for a timepiece according to claim 4, wherein the output mobile assembly comprises an assembling shaft and at least one assembling ring which is slipped on the assembling shaft and which supports the first ratchet in a way so as to couple the first ratchet to the assembling shaft, the first input wheel being mounted in a rotating way on the assembling ring which comprises the retaining shoulder.

6. The reverser for a timepiece according to claim 3, wherein the output mobile assembly comprises an assembling shaft which passes through at least the first input wheel, the second input wheel, and the first ratchet.

7. The reverser for a timepiece according to claim 1, wherein the first satellite pinion and the second satellite pinion are located between the first input wheel and the second input wheel.

8. The reverser for a timepiece according to claim 7, further comprising:

a separation plate located between a circular path of the first satellite pinion and a circular path of the second satellite pinion.

9. The reverser for a timepiece according to claim 1, further comprising:

a plurality of first satellite pinions able to co-operate with the first ratchet in a way so as to lock in rotation of the output mobile assembly with respect to the first input wheel only in the first direction of rotation.

10. A self-winding watch, comprising a reverser for a timepiece according to claim 1.

11. The self-winding watch according to claim 10, further comprising:

a gear train for driving the first input wheel and the second input wheel in rotation in opposite directions.

* * * * *